US008882378B2

(12) United States Patent
Bylsma et al.

(10) Patent No.: US 8,882,378 B2
(45) Date of Patent: Nov. 11, 2014

(54) HEATING AND DISPENSER SYSTEM

(75) Inventors: Richard B. Bylsma, Ada, MI (US); Steve O. Mork, Lowell, MI (US); David W. Baarman, Fennville, MI (US); Thomas A. Niezgoda, Kentwood, MI (US); Jesse Leverett, Rockford, MI (US)

(73) Assignee: Access Business Group International LLC, Ada, MI (US)

( * ) Notice: Subject to any disclaimer, the term of this patent is extended or adjusted under 35 U.S.C. 154(b) by 376 days.

(21) Appl. No.: 12/705,875

(22) Filed: Feb. 15, 2010

(65) Prior Publication Data

US 2011/0200381 A1 Aug. 18, 2011

(51) Int. Cl.
*A47L 13/32* (2006.01)
*B43M 1/02* (2006.01)

(52) U.S. Cl.
USPC ..... 401/1; 601/17; 401/25

(58) Field of Classification Search
USPC ..... 401/1, 2, 188 R; 219/229; 222/146.5, 222/325, 372; 601/15, 17
See application file for complete search history.

(56) References Cited

U.S. PATENT DOCUMENTS

| | | | | | |
|---|---|---|---|---|---|
| 1,772,501 | A | * | 8/1930 | Shelton | 601/17 |
| 3,335,910 | A | | 8/1967 | Rossi | |
| 3,578,945 | A | * | 5/1971 | Ayres et al. | 219/214 |
| 3,588,467 | A | | 6/1971 | Grosjean | |
| 3,752,155 | A | * | 8/1973 | Blinoff et al. | 601/19 |
| 3,843,022 | A | * | 10/1974 | Radcliffe et al. | 222/146.3 |
| 3,848,607 | A | | 11/1974 | St. Clair | |
| 4,253,013 | A | * | 2/1981 | Mabuchi | 219/521 |
| 4,291,685 | A | * | 9/1981 | Taelman | 601/17 |
| 4,427,001 | A | * | 1/1984 | Kiefer et al. | 601/17 |
| 4,465,073 | A | * | 8/1984 | Schwob | 606/134 |
| 4,865,034 | A | * | 9/1989 | Van Der Molen | 606/134 |
| 5,395,175 | A | * | 3/1995 | Bontoux et al. | 401/1 |
| 5,556,468 | A | * | 9/1996 | Legrain et al. | 118/202 |
| 5,775,344 | A | | 7/1998 | Clay | |
| 5,816,726 | A | | 10/1998 | DeBourg et al. | |

(Continued)

FOREIGN PATENT DOCUMENTS

| | | |
|---|---|---|
| CN | 1182562 | 5/1998 |
| CN | 1314802 | 9/2001 |

(Continued)

OTHER PUBLICATIONS

Irvin H. Blank, Robert J. Scheuplein, and Dorothy J. MacFarlane, Mechanism of Percutaneous Absorption, The Journal of Investigative Dermatology, 1967, 582-589, vol. 49 No. 6.

(Continued)

*Primary Examiner* — David J. Walczak
*Assistant Examiner* — Jennifer C Chiang
(74) *Attorney, Agent, or Firm* — Warner Norcross & Judd LLP

(57) ABSTRACT

A heating and dispenser system including base unit and an applicator assembly. The applicator assembly may include an applicator tip, a dispensing module, and an applicator housing. The applicator assembly may be integral or separable, and may also house a heating module. Alternatively, the heating module may be separate from the applicator assembly. The system also includes a control system for heating and dispensing various products. The applicator assembly may be replaceable, interchangeable, or single-type for applying product to a surface. The applicator may also be constructed of materials that impact heat transfer or storage.

27 Claims, 9 Drawing Sheets

(56) References Cited

U.S. PATENT DOCUMENTS

| | | | | |
|---|---|---|---|---|
| 5,831,245 | A * | 11/1998 | Debourg et al. | 219/242 |
| 5,903,465 | A | 5/1999 | Brown | |
| 5,980,144 | A | 11/1999 | DeBourg et al. | |
| 6,072,362 | A | 6/2000 | Lincoln | |
| 6,141,227 | A | 10/2000 | Sheikh et al. | |
| 6,157,258 | A | 12/2000 | Adishian et al. | |
| 6,177,093 | B1 | 1/2001 | Lombardi et al. | |
| 6,232,585 | B1 | 5/2001 | Clothier et al. | |
| 6,255,635 | B1 | 7/2001 | Thompson et al. | |
| 6,271,508 | B1 | 8/2001 | Thompson et al. | |
| 6,312,397 | B1 | 11/2001 | Gebhard | |
| 6,316,756 | B1 | 11/2001 | Thompson et al. | |
| 6,348,679 | B1 | 2/2002 | Ryan et al. | |
| 6,359,267 | B1 | 3/2002 | Wilcox et al. | |
| 6,437,295 | B1 | 8/2002 | Hogg et al. | |
| 6,521,874 | B2 | 2/2003 | Thompson | |
| 6,527,143 | B1 | 3/2003 | Schomäcker | |
| 6,600,142 | B2 | 7/2003 | Ryan et al. | |
| 6,617,557 | B1 | 9/2003 | Ryan et al. | |
| 6,649,888 | B2 | 11/2003 | Ryan et al. | |
| 6,652,175 | B2 * | 11/2003 | Chang | 401/2 |
| 6,664,881 | B1 | 12/2003 | Thompson et al. | |
| 6,709,180 | B2 * | 3/2004 | Cochran | 401/1 |
| 6,730,894 | B2 | 5/2004 | Thompson et al. | |
| 6,795,645 | B2 * | 9/2004 | Hygema et al. | 392/477 |
| 6,812,445 | B2 | 11/2004 | Gorbold | |
| 6,856,861 | B2 | 2/2005 | Dirksing et al. | |
| 6,861,629 | B2 | 3/2005 | Dahake et al. | |
| 6,911,010 | B2 * | 6/2005 | Dirks et al. | 601/15 |
| 6,995,345 | B2 | 2/2006 | Gorbold | |
| 7,108,438 | B2 | 9/2006 | Fontaine | |
| 7,201,294 | B2 * | 4/2007 | Carlucci et al. | 222/146.3 |
| 7,208,707 | B2 | 4/2007 | Clothier et al. | |
| 7,227,108 | B2 | 6/2007 | Clothier et al. | |
| 7,322,945 | B2 * | 1/2008 | Dunmore | 601/15 |
| 7,448,814 | B2 * | 11/2008 | Bouix et al. | 401/2 |
| 7,489,530 | B2 | 2/2009 | Paull | |
| 7,551,011 | B2 | 6/2009 | Paull | |
| 7,626,463 | B2 | 12/2009 | Paull | |
| 7,695,207 | B1 * | 4/2010 | Laghi | 401/2 |
| 7,804,045 | B2 | 9/2010 | Rosenbloom et al. | |
| 7,883,287 | B2 * | 2/2011 | Thorpe | 401/266 |
| 7,909,044 | B2 * | 3/2011 | Tranchant et al. | 132/218 |
| 2003/0165550 | A1 | 9/2003 | Rhoades | |
| 2004/0096258 | A1 * | 5/2004 | Kim | 401/1 |
| 2006/0287616 | A1 | 12/2006 | Nan | |
| 2007/0049998 | A1 | 3/2007 | Conrad et al. | |
| 2007/0269251 | A1 * | 11/2007 | Skalitzky et al. | 401/2 |
| 2007/0286665 | A1 | 12/2007 | Bouix et al. | |
| 2008/0031833 | A1 | 2/2008 | Oblong et al. | |
| 2009/0208542 | A1 | 8/2009 | Barrow | |
| 2009/0208592 | A1 | 8/2009 | Barrow | |
| 2009/0209600 | A1 | 8/2009 | Miner et al. | |
| 2009/0289055 | A1 * | 11/2009 | Baarman et al. | 219/660 |

FOREIGN PATENT DOCUMENTS

| | | |
|---|---|---|
| CN | 1761443 | 4/2006 |
| JP | 5095820 | 4/1993 |
| JP | 2006089458 | 4/2006 |
| JP | 2008110324 | 5/2008 |
| JP | 2008212688 | 9/2008 |
| JP | 2009119149 | 6/2009 |
| WO | 9605648 | 2/1996 |
| WO | 9617499 | 6/1996 |
| WO | 0021686 | 4/2000 |
| WO | 20071028033 | 3/2007 |
| WO | 20091103574 | 8/2009 |

OTHER PUBLICATIONS

Franklin Akomeah, Tahir Nazir, Gary P. Martin and Marc B. Brown, Effect of heat on the percutaneous absorption and skin retention of three model penetrants, European Journal of Pharmaceutical Sciences, 2004, 337-345, vol. 21.

S.E. Burgess, M.A.A. O'Neill, A.E. Beezer, J. Hadgraft and S. Gaisford, Thermodynamics of membrane transport and implications for dermal delivery, J. Drug Del. Sci. Tech., 2005, 325-327, vol. 15 No. 4.

Ozone Beauty Product, http://www.syouei.url.tw/eng/product.asp, downloaded before Dec. 1, 2009.

Rolling Heat Pen, http://www.syouei.url.tw/eng/product.asp?p_ir=15, downloaded before Dec. 1, 2009.

International Search Report and Written Opinion for International Application No. PCT1US20091044821, mailed Nov. 30, 2009.

U.S. Appl. No. 12/126,190; Office Action dated Jun. 21, 2011.

U.S. Appl. No. 12/126,190; Office Action dated Nov. 17, 2011.

U.S. Office Action for U.S. Appl. No. 12/126,190 mailed Feb. 14, 2014.

Notice of Allowance issued by the U.S. Patent & Trademark Office for U.S. Appl. No. 12/126,190 on Aug. 22, 2014.

* cited by examiner

HEATING AND DISPENSER SYSTEM

BACKGROUND OF THE INVENTION

The present invention relates to a system for dispensing and applying a personal product, and more particularly to a system for dispensing the personal product and applying the product with a heated applicator.

A wide variety of serums, salves and other health and beauty products are available for topical application. In some applications, these products are applied simply by hand. With many products, however, an applicator is available to assist the user in applying the product. Applicators are available in a variety of different types. Simple applicators may utilize a brush or foam pad to apply the product. In some applications, the applicator may be more complex and may include a reservoir for the product. One conventional applicator includes a rolling ball for applying the product. In a typical rolling ball applicator, the rolling ball is positioned in the neck of a product reservoir with a portion exposed on the exterior of the applicator. As the rolling ball is rolled within the neck, it draws product out from the reservoir. In some applications, the product may be heated prior to application. With some products, heat improves effectiveness, dispensability, or simply provides a more pleasant product application experience.

In some applicators, an applicator tip is used to spread product over the surface of the skin. These applicator tips are available in many shapes and sizes, depending on the particular situation and user preference. For example, an applicator tip in the form of a sphere, such as the rolling ball, may be desired to spread a product evenly over an area, while an applicator tip in the form of a truncated cone may provide a bead of product on a surface.

In the rolling ball example described above, the user cannot use the applicator tip with more than one product because the applicator tip is not removable from applicator. As a result, the user must purchase multiple applicators to use more than one product. Purchasing multiple applicators, each with their own applicator tip, can be costly because the applicator tip is usually the most expensive portion of the applicator. Moreover, it is often difficult to clean the applicator tip separately from the applicator in this configuration.

Many products are dispensed at elevated temperatures for a variety of reasons. For example, personal care products, such as lotions, can be more effective and more soothingly applied to the skin when the skin, product, or both are warmed to the skin temperature or above. Absorption may increase when the skin is heated and product is then applied. A product may also be more malleable if its temperature is increased. In addition, vibration and massage techniques may be used to increase absorption of product into product application surface, such a user's skin.

In one example, a conventional applicator uses a heat source in contact with the product. This technique elevates the temperature of the product with the aim of increasing absorption. However, many personal care products degrade when placed in direct contact with a heat source for an extended period of time. As result, the product does not always perform its intended function, such as properly moisturizing the skin, when applied using this technique.

In other examples, conventional application techniques include using a separate heating appliance and product dispenser. As a result, a user may experience the inconvenience of maintaining both the heating appliance and the product dispenser in the same location. If one is misplaced or lost, the user may not be able to realize the benefits of the technique described above.

SUMMARY OF THE INVENTION

The present invention provides a heating and dispenser system for applying serums, salves and other health and beauty products. The heating and dispenser system includes a base unit, a surface-contacting tip assembly, a heat module for selectively heating the surface-contacting tip assembly, and an applicator assembly attached to the surface-contacting tip assembly. The applicator assembly includes a dispenser module and applicator housing, where one or both may be attached to the surface-contacting tip assembly. The applicator assembly may also be equipped with a device, such as a valve, for selectively dispensing product, for regulating the amount of product dispensed, or for allowing the user to stop dispensing product for a period of time.

In one embodiment, the device for selectively dispensing product includes a nozzle or product output to apply the product. The surface-contacting tip assembly and the nozzle may be located on the applicator assembly such that a heated area of the surface-contacting tip assembly is outside the nozzle.

In another embodiment, the heating and dispenser system includes a partially disposable applicator assembly with an attachable and interchangeable surface-contacting tip assembly. A plurality of surface-contacting tip assemblies may be used, depending on the particular application usage. For example, a curved tip may be used for some applications, while a flat tip may be suitable for other applications.

In another embodiment, the heating and dispenser system includes an applicator assembly with a non-interchangeable surface-contacting tip assembly, where the two are permanently joined.

In one embodiment, the heating and dispenser system includes a surface-contacting tip assembly that is partially formed of a material with a desirable combination of material properties, such as thermal mass and thermal conductivity. A surface-contacting tip assembly including such a material may conserve power contained within the applicator assembly and effectively transfer heat to the portion of the surface-contacting tip assembly making contact with a product application surface, such as a user's skin.

In one embodiment, the heating and dispenser system includes a separable applicator assembly, which separates into a surface-contacting tip assembly, applicator housing, and dispenser module. The applicator housing includes a cavity for receiving the dispenser module in a cartridge form. The cavity includes a securing device for holding the dispensing module in place within the applicator module, and for allowing the dispensing module to dispense product as desired by the user. The dispensing module may also include a separate dispensing device for regulating the amount of product dispensed. The dispensing module, applicator housing, or both may selectively attach to the surface-contacting tip assembly.

In one embodiment, the heating and dispenser system includes a heating module that may be located within the base unit or the applicator assembly. The heating module provides heat energy to the surface-contacting tip assembly. The heating module may be a resistive heating element, such as a wire or ceramic type, or other suitable construction. There may also be a control unit within the base unit or applicator assembly to regulate the amount of power the heating element transfers to the surface-contacting tip assembly.

In another aspect, the heating and dispenser system includes a vibration mode, which allows a user to vibrate the surface-contacting tip assembly. Vibration of the product application surface may improve absorption of the product.

To produce vibration, the applicator module may include an off-center motor and cam or a piezoelectric motor.

These and other objects, advantages, and features of the invention will be readily understood and appreciated by reference to the detailed description of the current embodiment and the drawings.

DETAILED DESCRIPTION

Figure 1:
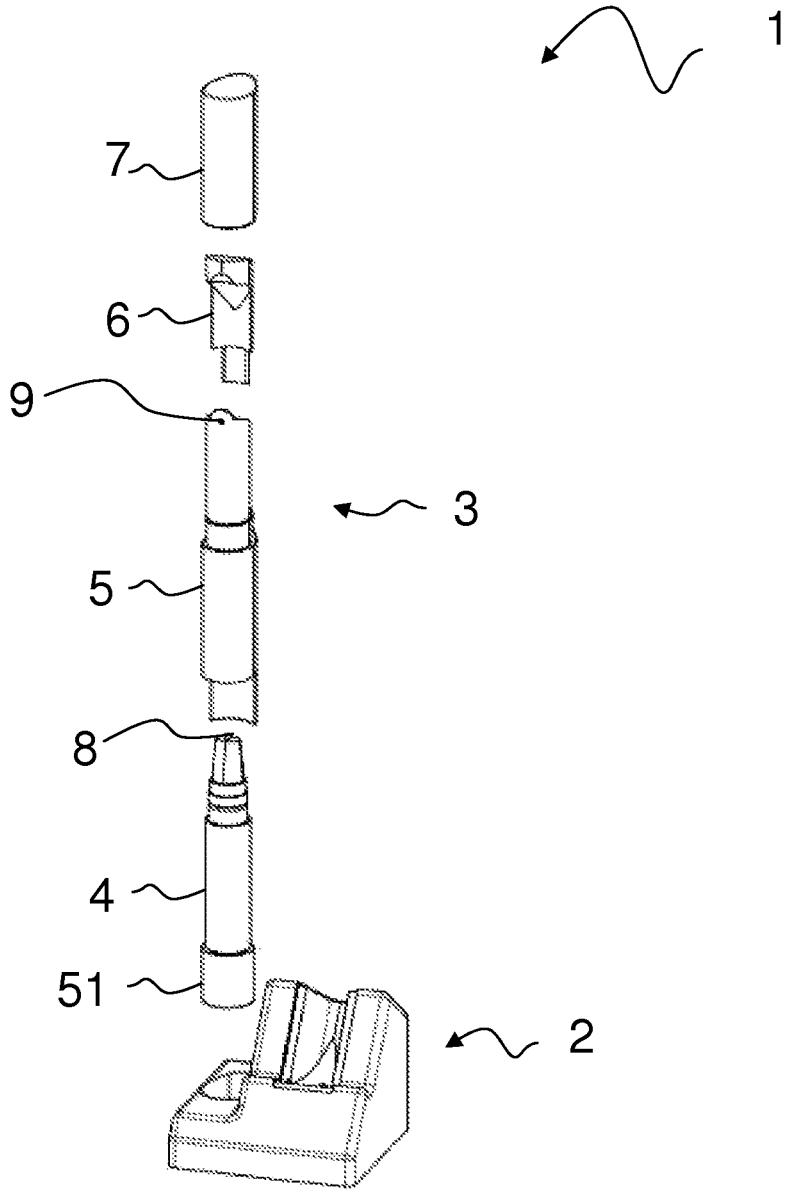
FIG. 1 illustrates an exploded view of one embodiment of the heating and dispenser system.
Figure 2:
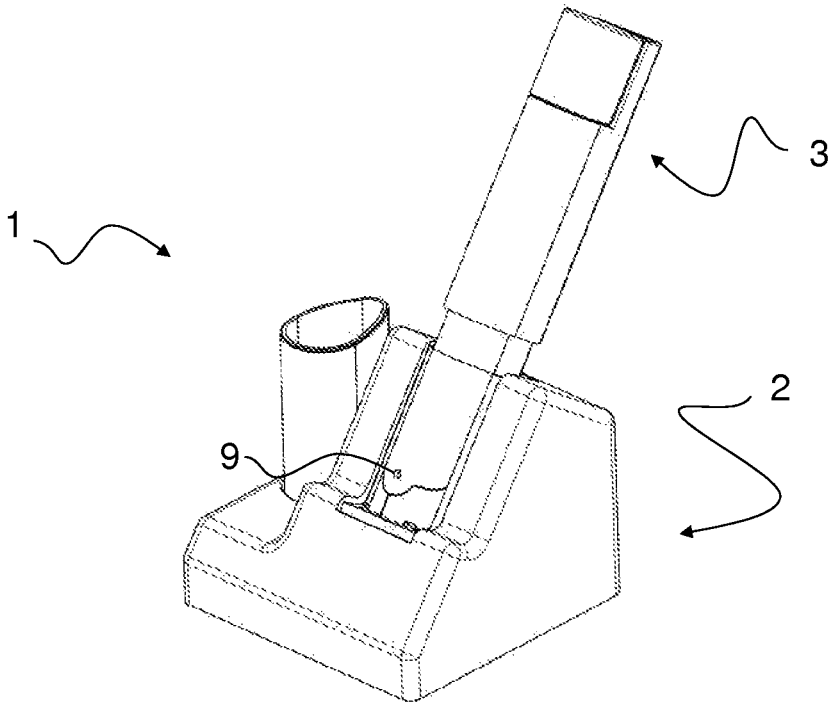
FIG. 2 illustrates a perspective view of one embodiment of the heating and dispenser system.
Figure 3:
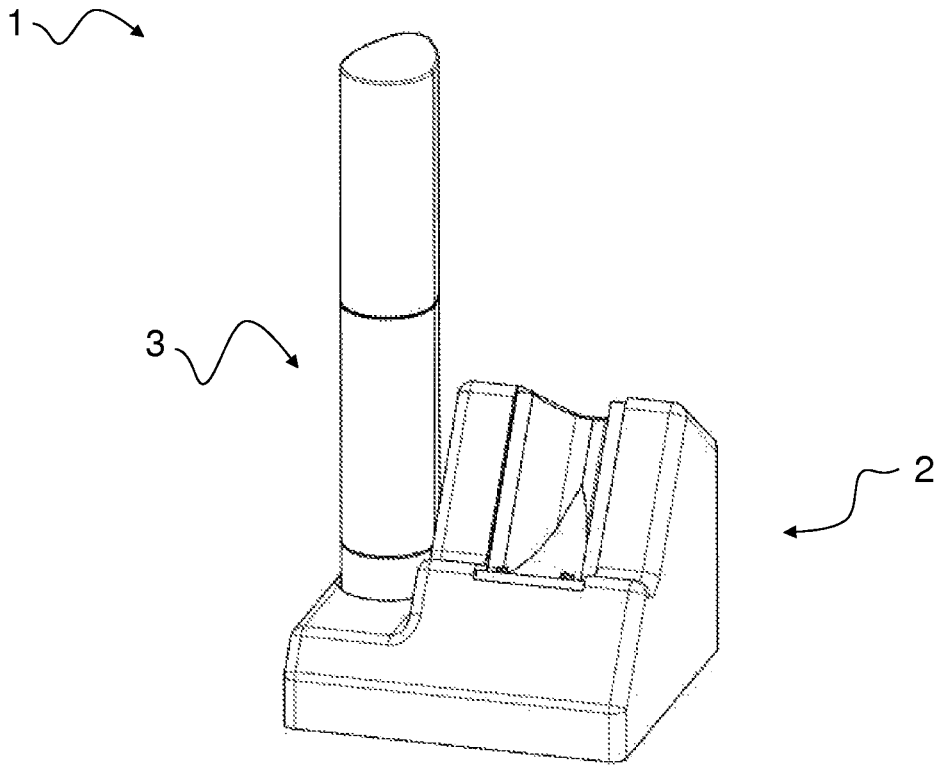
FIG. 3 illustrates a perspective view of one embodiment of the heating and dispenser system.

FIGS. 1-3 show an embodiment of a heating and dispenser system 1 including a base unit 2 and an applicator assembly 3. The base unit 2 may receive power from various suitable power sources, such as a wall outlet, battery, or other suitable power source. The base unit 2 includes a receptacle for storing the applicator assembly 3 and a receptacle for transferring energy to the applicator assembly 3. The receptacles may include a latching mechanism for securing the applicator assembly 3 in place. FIG. 2 shows an energy transfer configuration of the heating and dispenser system 1, and FIG. 3 shows a storage configuration of the applicator assembly 3 in the base unit 2. The base unit 2 may provide energy to the applicator assembly 3 at least in response to the applicator assembly 3 being placed in the receptacle for transferring energy. The heating and dispenser system 1 may initiate energy transfer to the applicator assembly 3 using various techniques in addition to placement of the applicator assembly 3 in the receptacle for transferring energy. In one embodiment, the heating and dispenser system 1 may use a reed switch or other proximity detector to detect the presence of the applicator assembly 3 in the receptacle for transferring energy. Once the applicator assembly 3 is placed in the receptacle for transferring energy and the reed switch detects presence, the heating and dispenser system 1 may begin transferring energy to the applicator assembly 3. Alternative embodiments may continuously or intermittently poll using various methods to determine presence of the applicator assembly 3. For example, the base unit 2 may have a primary coil that can be used to ping for the presence of a secondary coil, which may be included in the applicator assembly 3. In yet other embodiments, the heating and dispenser system 1 may use a user-provided input on either the applicator assembly 3 or the base unit 2 to select an energy transfer mode. Energy transfer may be initiated when an energy transfer mode is selected in addition to placement of the applicator assembly 3 in the receptacle for transferring energy. The user-provided input may be selected before or after the applicator assembly 3 is placed in the receptacle for transferring energy. The base unit 2 may provide energy to the applicator assembly 3 in the form of heat energy, electrical energy via electrical contacts, or inductive power coupling. The described embodiments are not limited to these energy transfer configurations and other suitable energy transfer methods may be used.

In the illustrated embodiments, the applicator assembly 3 includes a dispenser module 4, applicator housing 5, surface-contacting tip assembly 6, and cap 7. Cap 7 may cover the applicator assembly 3 when not in use. The applicator housing 5 may include a cavity for receiving dispenser module 4 and an engagement area for attaching and removing the surface-contacting tip assembly 6. Alternatively, the engagement area may be included on the dispenser module 4 or a combination of the dispenser module 4 and applicator housing 5.

The dispenser module 4 includes a product cartridge and an activation mechanism 51. Further, the product cartridge includes a cartridge outlet 8. In some embodiments, the product cartridge may be replaceable and in others, it may not be replaceable and forms a part of the dispenser module 4. The dispenser module 4 may be inserted into a cavity of the applicator housing 5 and secured in place using a securing mechanism, such as a clip. Those skilled in the art will recognize there are a myriad of securing mechanisms suitable for this function. The applicator housing 5 and the dispenser module 4 are separable in this embodiment, but may be permanently joined into one structure in other embodiments.

The product cartridge may also include an indicator of product capacity, such as a translucent or transparent window allowing a user to view the product remaining in the cartridge. Alternatively, a measurement system may be included to communicate the amount of product remaining to a display unit on a portion of the heating and dispenser system. In another alternative embodiment, the measurement system may be connected to the base unit 2 and heat module to restrict the heating process based on the presence or absence of product in the product cartridge. A measurement system may utilize RFID or other communication means to relay status information to the base unit 2 or heat module or both. Alternatively, the applicator assembly 3 including the applicator housing 5, product cartridge, or dispenser module 4 may include a power source, such as a battery, which provides power to the measurement system.

In the illustrated embodiments, the cartridge outlet 8 may dispense product to the dispensing nozzle 9 through a connecting conduit, where the dispensing nozzle 9 dispenses product to a product application surface. In alternative embodiments, the dispensing nozzle 9 may be integrated into the product cartridge. As a result, the cartridge outlet 8 may be a dispensing nozzle.

Further, the heating and dispenser system 1 may regulate dispensing of the product or serum through the dispensing nozzle 9 by activation of a mechanism 51 on the dispensing module 4. The activation mechanism 51 may be a push button, screw, or other appropriate mechanism. A user may manually activate the activation mechanism 51 or there may be a controller capable of receiving dispenser commands and activating the mechanism 51 based on user supplied inputs. In alternative embodiments, the activation mechanism 51 may be located elsewhere in the applicator assembly 3, such as the applicator housing 5.

The dispense nozzle 9 may be located on the application assembly 3 relative to a heated area of the surface-contacting tip assembly 6. The dispense nozzle 9 may be a single outlet or a plurality of outlets capable of releasing product or serum. In one example, the dispense nozzle 9 may be a single annular outlet with a space for releasing product formed between the outer and inner diameter of the annular outlet. The heated area of the surface-contacting tip assembly may be within the inner diameter of the dispense nozzle 9 or it may be outside the outer diameter of the dispense nozzle 9. As another example, the dispense nozzle 9 may be a plurality of outlets that form a circular pattern. In this example, the heated area of the surface-contacting tip assembly may be near the center or outside of the circular pattern of outlets forming dispense nozzle 9. In yet another example, the dispense nozzle 9 may be a plurality of outlets with a portion of the heated area of the surface-contacting tip assembly 6 between them. Alternatively, the outlets of dispense nozzle 9 may be situated such that no portion of the heated area of the surface-contacting tip assembly 6 is between them. In this example, the dispense nozzle 9 may be described as being located such that a portion of the heated area of the surface-contacting tip assembly 6 is located outside the dispense nozzle 9. Further, the placement of dispense nozzle 9 in this configuration may prevent product from contacting the heated area of the surface-contacting tip assembly 6 when it is dispensed from dispense nozzle 9. This may prevent the product from degrading and allow it to perform its intended function.

In the current embodiment, a shield (not shown) may be placed between the heater or surface-contacting tip assembly 6 and the product flow path from the cartridge outlet 8 to dispense nozzle 9. The shield may further prevent the product from contacting a heat source within the applicator assembly 3. The shielding construction may be materials such as foils or other high conductivity materials capable of directing heat away from the product. Alternatively, the shielding may be a material with a high insulative property that prevents heat transfer to the product.

In the illustrated embodiments, the surface-contacting tip assembly 6 may be detachable, removable, or replaceable from the applicator assembly 3. This feature may allow a user to more easily clean the surface-contacting tip assembly 6 separately from the applicator assembly 3. It may also allow a user to use a combination of various surface-contacting tip assemblies 6. In addition, it may allow a user to use a decorated or personalized surface-contacting tip assembly 6 with multiple applicator assemblies 3. In alternative embodiments, the surface-contacting tip assembly 6 may be permanently affixed to the applicator assembly 3. It should be understood that the term tip assembly could include a tip including multiple components or a single component. For example, the tip assembly may include a metal portion intended to interface with a user's skin and a plastic portion that allows the tip assembly to attach to the applicator assembly. Or, in alternative embodiments, the tip assembly may be a single component, such as a piece of metal formed on one to provide a surface for interfacing with a user's skin and on the other end an interface to attach to the applicator assembly.

The surface-contacting tip assembly 6 may be constructed of a variety of materials, such as those that retain heat (e.g. high thermal mass), those that easily conduct heat (e.g. high thermal conductivity), or a combination of both. It may be desirable to utilize a material with a higher thermal conductivity because such a material may more effectively transfer heat energy to the product application surface to increase its absorption abilities. In addition, the thermal mass of the surface-contacting tip assembly 6 may affect the ability of the surface-contacting tip assembly 6 to maintain a temperature range for a period of time during use on a product application surface. Accordingly, it may be desirable to use a material with a high thermal mass property so that the overall size of the surface-contacting tip assembly 6 may be reduced. Example materials with similar properties may be copper, ceramic, aluminum, stainless steel, and nickel. These are but some of the materials that may be used to construct surface-contacting tip assembly 6.

Various shapes of surface-contacting tip assemblies 6 may be provided. The shape of the surface-contacting tip assembly may depend upon the type of material being applied, the type of surface receiving the material, or a variety of other factors. For example, a spherical shape may be desired for applying material to human skin or another product application surface. Alternatively, a planar applicator or pyramidal applicator may be a more preferred shape for applying material to human skin or another product application surface.

In the illustrated embodiments, the heating and dispenser system 1 may have safety or other indicator features. The base unit 2 or applicator assembly 3 may include indicator lights, such as LEDs, to indicate an operating state. For example, the indicator lights may provide information such as the desired temperature setting, the operating temperature, power status, charging status, or heating status. Alternatively, the indicator features may include a graphic display to perform functionality similar to the indicator lights. In an alternative embodiment, the surface-contacting tip assembly 6 may include a thermochromic dye to provide a visual indication as to whether the device is below operating temperature, at operating temperature, or above operating temperature.

In the illustrated embodiments, the heating and dispenser system 1 may have user-provided inputs (not shown). The base unit 2 or the applicator assembly 3 may include switches or push buttons, or other suitable user feedback configurations as are well known in the art. The user-provided inputs may be directly or indirectly connected to a heat module, dispenser module 4, a controller such that the controller receives user commands, or any other component within the heating and dispenser system 1. Further, the user-provided inputs may be associated with user commands for the heating and dispenser system 1, such as initiating energy transfer to the heat module, directing the dispenser module 4 to begin dispensing, or notifying the controller to initiate various user commands. Other user commands, for example, may include setting the current operating mode (e.g. energy transfer mode or off mode), selecting a temperature setting, or selecting a vibration mode.

Figure 4:
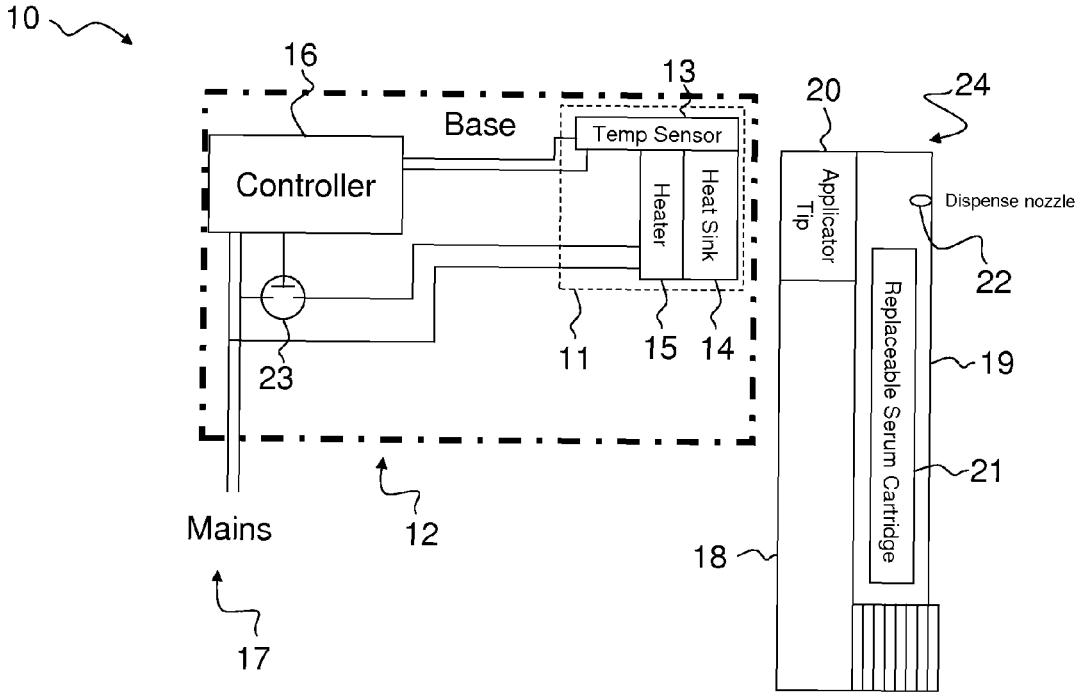
FIG. 4 is a schematic view of a heating and dispenser system of one embodiment of the present invention in a first configuration.

FIG. 4 shows the heating and dispenser system 10 in accordance with an embodiment of the invention directed to thermally conductive heating (passive heating) of the surface-contacting tip 20. The heating and dispenser system 10 includes a base unit 12 and applicator assembly 24. The applicator assembly 24 is similar to the applicator assembly 3 described above, where it may include the following corresponding features: a surface-contacting tip assembly 20, applicator housing 18, dispenser module 19, product cartridge 21, and dispensing nozzle 22. In this embodiment, the surface-contacting tip assembly 20 may receive heat from the heat module 11 by thermal conduction through heat sink 14. The applicator assembly 24 may be placed in the base unit 12 receptacle to transfer heat to the surface-contacting tip assembly 20. Alternatively, the surface-contacting tip assembly 20 may be removed from the applicator assembly 24 and placed separately in the base unit 12 receptacle for heating. After heating is finished, the surface-contacting tip assembly 20 may be re-engaged with the applicator assembly 24 for use.

The base unit 12 is similar to the base unit 2 described above. With reference to FIG. 4, some of the features of base unit 12 are described in more detail. The base unit 12 includes mains input 17, a controller 16, switching circuit 23, and heat module 11. The controller 16 and switching circuit 23 receive power from the mains input 17, and include circuitry that is well known in the art. The controller 16 is further connected to switching circuit 23, and may selectively control switching circuit 23 to regulate the output power or the amount of heat output from the heat module 11. The controller 16 or heat module 11 may also receive feedback from the temperature sensor 13 to further control output power depending on the operating temperature of the heat module 11 and a desired temperature setting.

The heat module 11 includes a temperature sensor 13, a heat sink 14, and a heater 15. The heater 15 may be a resistive heating element, such as a wire or ceramic type, or another suitable construction. Further, the heater 15 may be a cartridge, foil, or essentially any other type of heater capable of heating the applicator tip in a suitable manner. The temperature sensor 13 may be a thermocouple or another sensor capable of translating temperature to an electrical signal. In the illustrated embodiment, the temperature sensor 13 is shown connected to the controller 16, but in alternative embodiments, the sensor may provide information to other components within the base unit. The controller 16 may provide power to the heat module 11 when the surface-contacting tip assembly 20 is present in a receptacle of base unit 12. The heat sink 14 transfers heat energy from the heater 15 to the surface-contacting tip 20, which is adjacent to the heat sink 14 when the surface-contacting tip 20 is located in the receptacle of the base unit 12. To perform this function, the heat sink 14 may be a material with sufficiently high heat conductivity, such as copper or aluminum.

In the current embodiment, the base unit 12 includes receptacles for locating the surface-contacting tip assembly 20 during the heating process or for storage. The surface-contacting tip assembly 20 may be heated in the base unit 12 such that it retains a predetermined temperature for a period of time. Predetermined temperatures and time periods, for example, may be 50 C-37 C for 4 minutes, 48 C-42 C for 3 minutes, or 47 C-43 C for 2 minutes. In an alternative operation, a surface-contacting tip assembly 20 may be separated from the applicator assembly 24 and placed within the receptacle for heating. Once it is finished heating, the surface-contacting tip assembly 20 is removed from the receptacle and attached to the applicator assembly 24. At this time, a second surface-contacting tip assembly 20 may be placed in the receptacle for heating. In such a method, a user may continually use heated surface-contacting tip assemblies 20 by switching between one or more of them, while making sure one is placed in the heating receptacle of the base unit 12.

Additional embodiments of the heating and dispenser system 30, 70 will now be described in detail with reference to FIGS. 5 and 6. Each heating and dispenser system 30, 70 includes a base unit 31, 71 and applicator assembly 42, 75. Each applicator assembly 42, 75 is generally similar to the applicator assembly 3 described above, where it includes the following corresponding features: a surface-contacting tip assembly 41, 80, applicator housing 47, 52, dispenser module 43, 53, product cartridge 46, 81, and dispensing nozzle 44, 82. Referring now to the embodiment of FIG. 5, the applicator assembly 42 includes applicator controller 37, secondary coil 36, storage element 39, temperature sensor 38, and heater 40. The temperature sensor 38 and heater 40 are similar to those described above with regard to the embodiments of FIGS. 1-4. In this embodiment, the heater 40 and temperature sensor 38 may located within the applicator assembly 42 and may be connected to the applicator controller 37 rather than the base unit controller 32. Applicator controller 37 may include circuitry well known in the art, and perform similar functionality to the controller 16 described above with respect to FIG. 4. For example, the applicator controller 37 may regulate the transfer of energy from the base unit 31 to the heater 79 based on a desired temperature setting and temperature information from temperature sensor 38. The applicator controller 37 may also regulate transfer of energy to and from storage element 39. Storage element 39 may be a supercapacitor or a battery, or a suitable alternative with appropriate charge storage capability to power heater 40 or extend the use time of the applicator assembly 42.

Each base unit 31, 71 is generally similar to the base unit 2 described above. With reference to FIG. 5, some of the features of base unit 31 are described in more detail. The base unit 31 includes mains input 34, controller 32, switching circuit 45, AC/AC converter 33, and primary coil 35. The controller 32 and switching circuit 45 include circuitry that is well known in the art. The controller 16 and switching circuit 45 receive power from the mains input 34. The controller 16 is further connected to switching circuit 45 to control the power output to the AC/AC converter 33 and the primary coil 35. The secondary coil 36 and primary coil 35 may be configured to inductively couple. This allows for transfer of energy between the base unit 31 and the applicator assembly 42 without direct electrical contacts. In this configuration communication between the base unit 31 and applicator assembly 42 may occur using discrete transceivers or a modulation technique. Discrete transceivers may be capable of communication using wireless protocols, such as Bluetooth or IrDA. Alternatively, primary coil 35 and secondary coil 36 may be used to communicate information while power transfer is occurring. The applicator assembly 42 and base unit 31 may use these or similar means to transmit or receive information, such as desired temperature information, current temperature information, or power requirement information. This may allow a user to select, for example, a desired temperature setting using a user-provided input located on either the applicator assembly 42 or base unit 31.

The controller 16, switching circuit 45, AC/AC converter 33, primary coil 35, and secondary coil 36 may form part of an inductive power supply system as described, for example, in U.S. Pat. No. 6,825,620, which is entitled "Inductively Coupled Ballast Circuit" and issued Nov. 30, 2004, to Kuennen et al; the adaptive inductive power supply of U.S. Pat. No. 7,212,414, which is entitled "Adaptive Inductive Power Supply" and issued May 1, 2007, to Baarman; the inductive power supply with communication of U.S. Ser. No. 10/689,148, which is entitled "Adaptive Inductive Power Supply with Communication" and filed on Oct. 20, 2003 to Baarman; the inductive power supply for wirelessly charging a LI-ION battery of U.S. Ser. No. 11/855,710, which is entitled "System and Method for Charging a Battery" and filed on Sep. 14, 2007 by Baarman; the inductive power supply with device identification of U.S. Ser. No. 11/965,085, which is entitled "Inductive Power Supply with Device Identification" and filed on Dec. 27, 2007 by Baarman et al; or the inductive power supply with duty cycle control of U.S. Ser. No. 12/349,840, which is entitled "Inductive Power Supply with Duty Cycle Control" and filed on Jan. 7, 2009 by Baarman—all of which are incorporated herein by reference in their entirety.

The applicator assembly 42 in the current embodiment may receive energy from the base unit 31 for transferring energy to heater 40 to heat the surface-contacting tip assembly 41. The surface-contacting tip assembly 41 and heater 40 may be in close proximity to each other to achieve efficient energy transfer. The secondary coil 36 may receive energy via inductive coupling with primary coil 35 and transfer this energy to the applicator controller 37. After receiving energy, the applicator controller 37 may regulate the energy to heater 40 to heat the surface-contacting tip 41. This may occur while the secondary coil 36 remains inductively coupled with the primary coil 35. In addition, the applicator controller 37 may transfer some of this energy to storage element 39 while secondary coil 36 and primary coil 35 are coupled. After the applicator assembly 42 is removed from the base unit 31 such that the secondary coil 36 is no longer coupled with the primary coil 35, the applicator controller 37 may monitor the temperature of the surface-contacting tip assembly 41 and regulate energy from the storage element 39 to the heater 40. This may allow the applicator assembly 42 to maintain the surface-contacting tip assembly 41 at a desirable temperature for an extended period.

The temperature sensor 38 provides temperature information to the applicator controller 37 so it may regulate the discharge of energy from the storage element 39 to maintain the surface-contacting tip assembly 41 within a particular temperature range for a period of time. For example, the particular temperature ranges and time periods may be 50 C-37 C for 4 minutes, 48 C-42 C for 3 minutes, or 47 C-43 C for 2 minutes. In alternative embodiments, a user-provided input on the applicator assembly 42 or the base unit 31 may provide the applicator controller 37 with a user desired temperature setting. The applicator controller 37 may then regulate the temperature of the surface-contacting tip assembly 41 according to a user's preference.

As described, the current embodiment may allow the applicator assembly 42 to extend the duration that the surface-contacting tip assembly 41 remains within a desirable temperature range. In alternative embodiments, the applicator controller 37 may not heat the surface-contacting tip assembly 41 while receiving energy from the base unit 31. In these embodiments, applicator 37 may store energy in the storage element 39. A user may then communicate with the applicator controller 37 via user-provided inputs on the applicator assembly 42 to begin heating the surface-contacting tip assembly 41. The energy stored in the storage element 39 may then be provided to the heater 40 under the direction of applicator controller 37.

Figure 5:
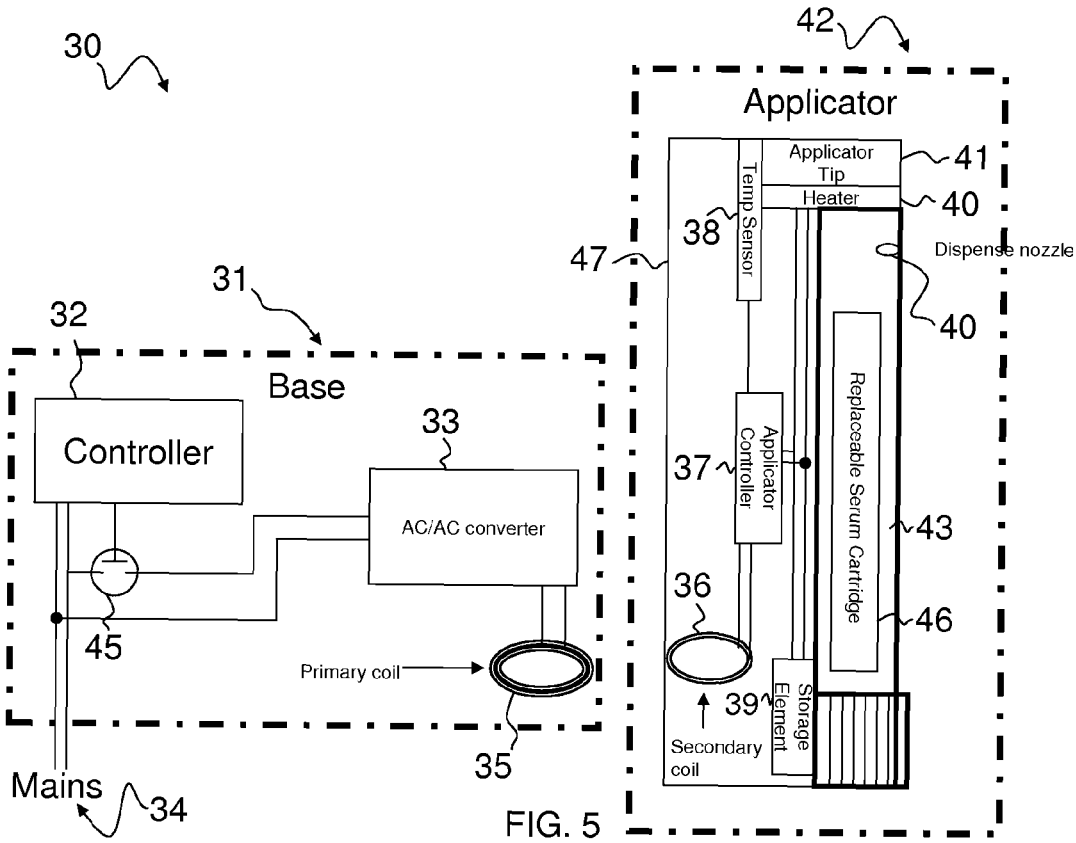
FIG. 5 is a schematic view of a heating and dispenser system of another embodiment of the present invention in a second configuration.
Figure 6:
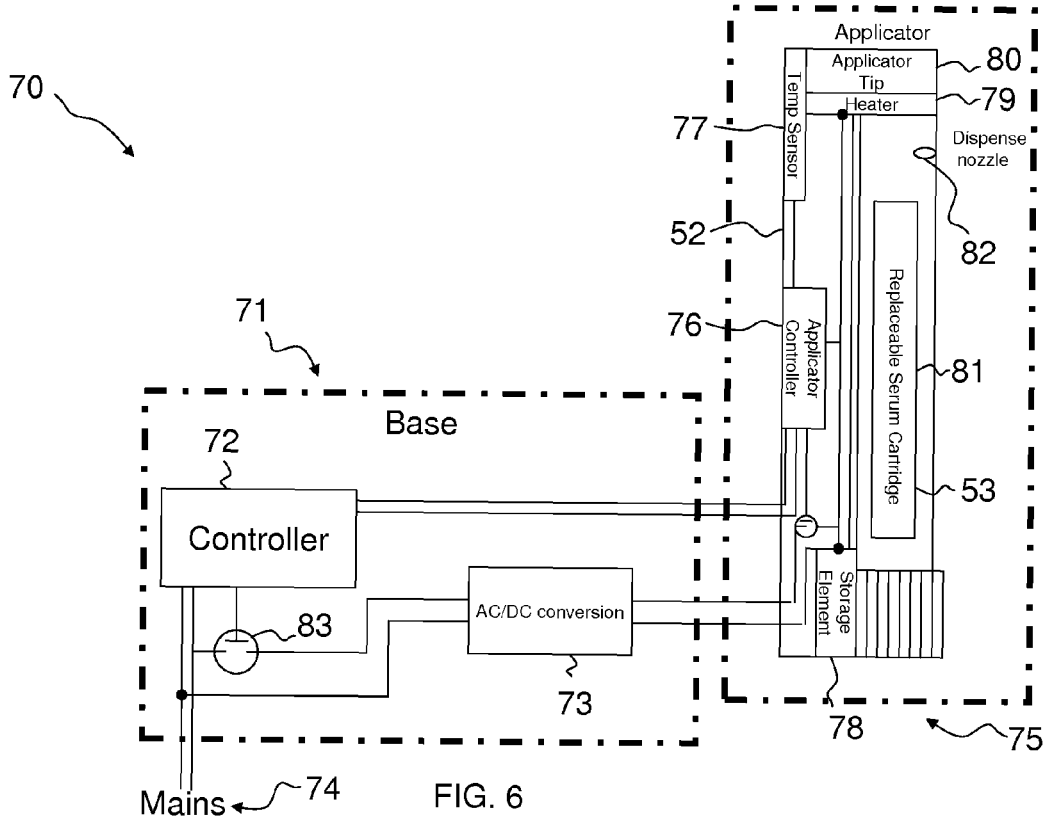
FIG. 6 is a schematic view of a heating and dispenser system of another embodiment of the present invention in a third configuration.

Referring now to FIG. 6, the illustrated embodiment is generally similar to the described embodiment of FIG. 5, except that electrical contacts may be used to supply power to applicator assembly 75 rather than an inductive power supply. In this embodiment, the applicator housing 52 and dispenser module 53 are joined into one applicator assembly 75, but may be separated in alternative embodiments. AC/DC converter 73 provides power to the applicator assembly 75 in combination with controller 72, switch circuit 83, and mains 74. AC/DC converter 73 may include circuitry capable of transforming AC input voltage, such as 120 VAC line voltage, to DC voltage. In this embodiment, controller 72 may use electrical contacts to communicate with applicator control 76. Information communicated may be similar to the communication described above for the embodiment of FIG. 5. The illustrated embodiment also includes an applicator switching circuit 84, which the applicator controller 76 uses to control the flow of energy from base unit 71. Applicator switching circuit 84 includes circuitry well known in the arts, such as a FET or other transistor type.

Figure 7:
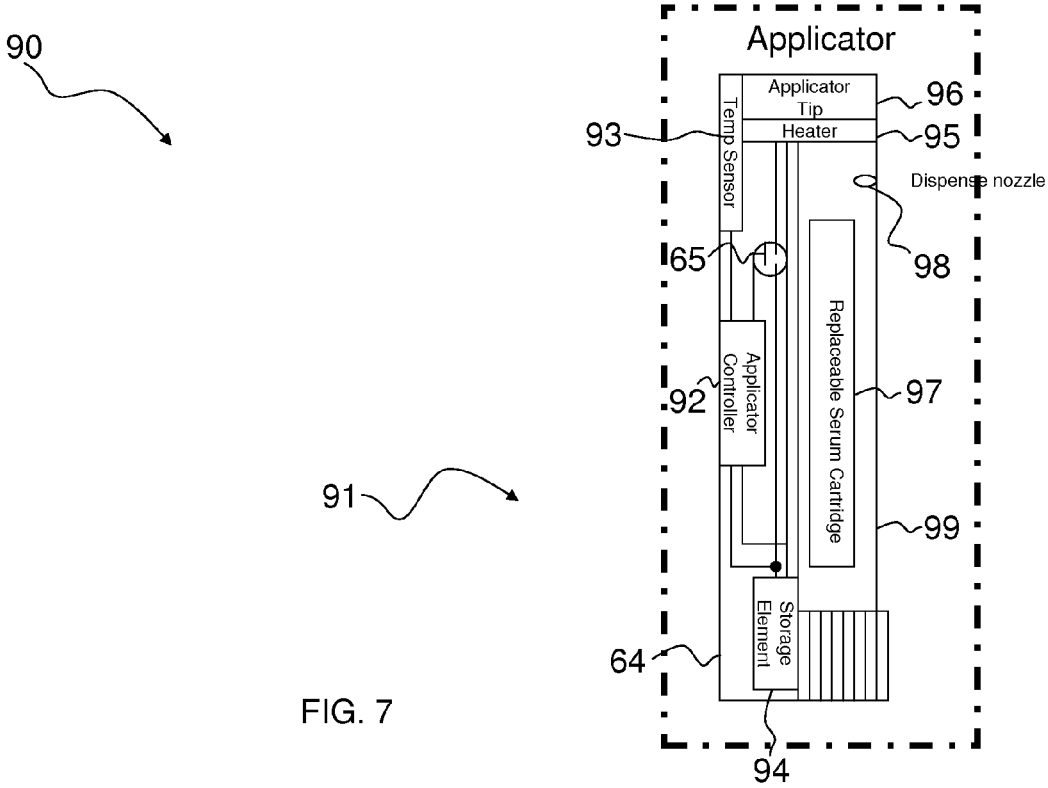
FIG. 7 is a schematic view of an applicator assembly of one embodiment of the present invention in a fourth configuration.

Referring now to FIG. 7, the illustrated embodiment includes an applicator assembly 91 similar to the previously described embodiments. As in other embodiments, the surface-contacting tip assembly 96 may be replaceable and removable, or it may be permanently affixed to the applicator assembly. Storage element 94 in applicator assembly 91 may be a one-time use or rechargeable battery. In the current embodiment, the applicator assembly 91 uses storage element 94 for power and may not use a base unit to supply power to the applicator assembly 91. Accordingly, the entire applicator assembly 91 may be disposable, or if the storage element 94 is rechargeable or replaceable, a user may select to reuse the applicator assembly 91.

Figure 8:
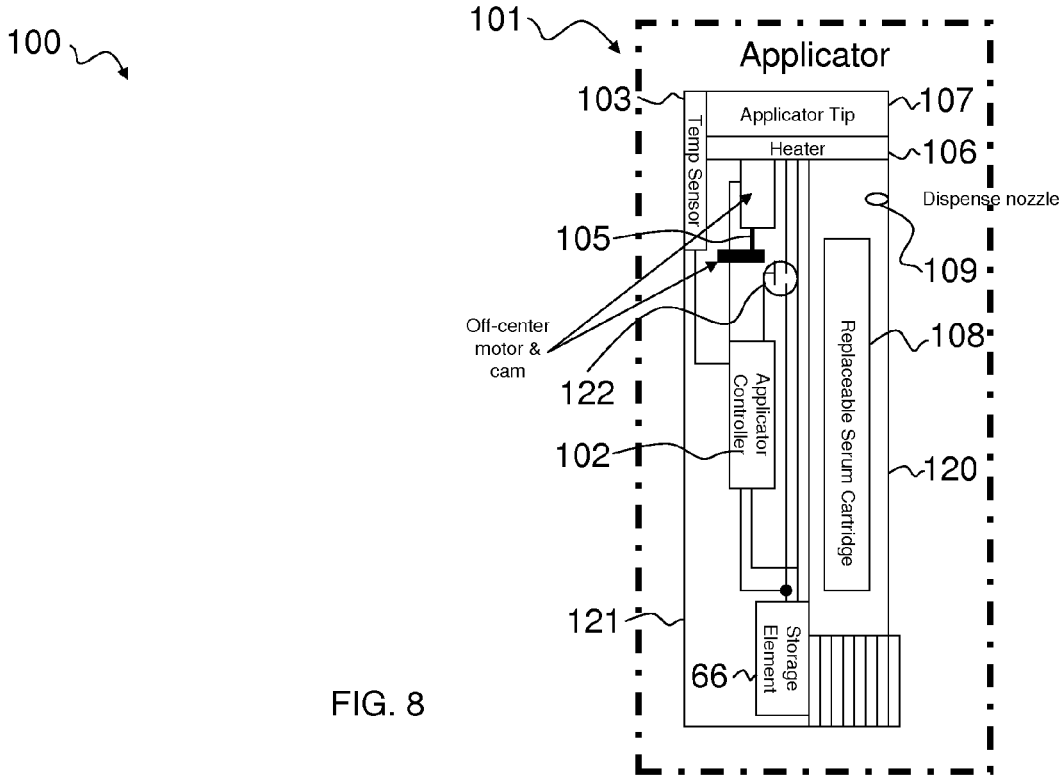
FIG. 8 is a schematic view of an applicator assembly of another embodiment of the present invention in a fifth configuration.
Figure 9:
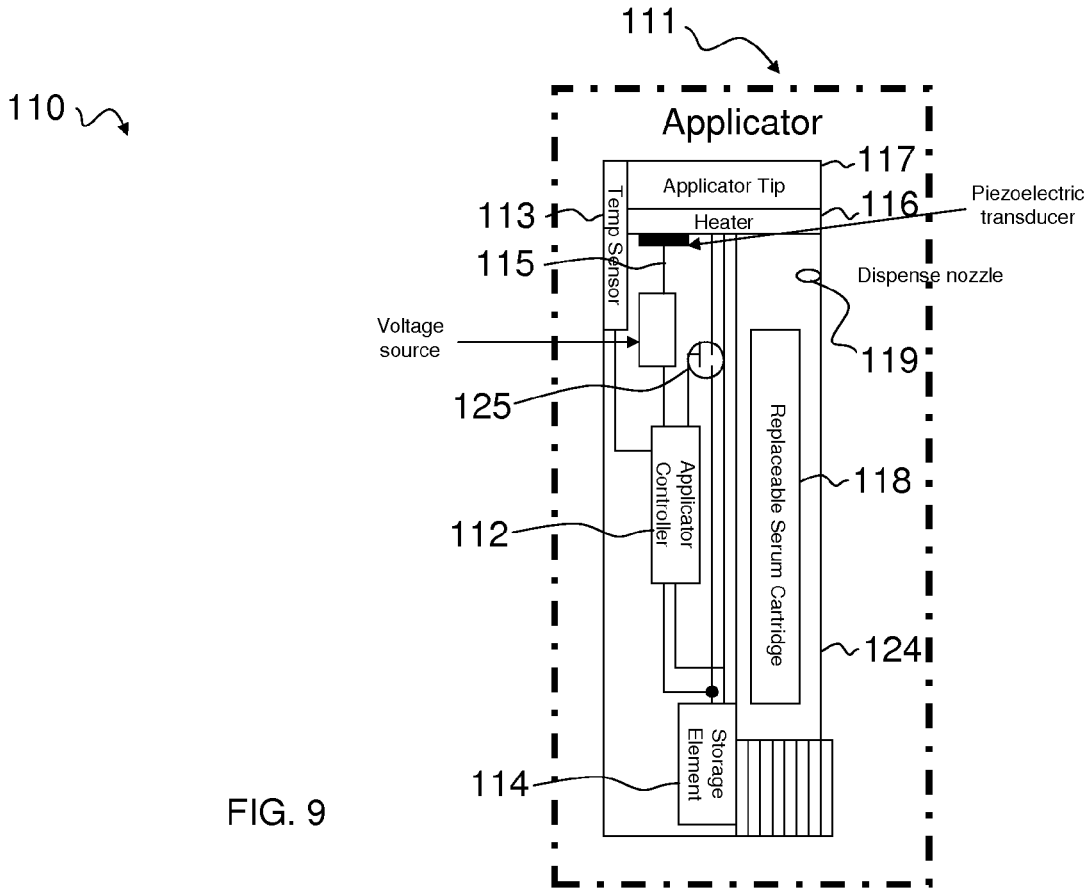
FIG. 9 is a schematic view of applicator assembly of one embodiment of the present invention in a sixth configuration.

In another aspect of the present invention shown in FIGS. 8 and 9, the heating and dispenser system 100, 110 includes vibration capabilities. Vibration may be desirable to enhance the application of product to human skin or to allow the product to more easily absorb into the product application surface. The applicator assembly 101, 111 includes features similar to the embodiments described above. The applicator assembly 101, 111 further includes vibrating assembly 105, 115. Vibrating assembly 105, 115 may be an off-center motor and cam or a piezoelectric transducer and voltage source, and may be located sufficiently near the surface-contacting tip assembly 107, 117 to cause vibration.

In the current embodiment, a user may select a particular vibration setting using user-provided inputs. These user-provided inputs may be in communication with applicator controller 102, 112, which may control operation of the vibration assembly 105, 115. For example, a user may select a vibration setting between 0 and 5, 5 being maximum vibration and 0 being the off position. The applicator controller 102, 112 may then provide the appropriate power to the vibration assembly 105, 115 to achieve the desired operation. Alternatively, the applicator controller 102, 112 may communicate the setting to the vibration assembly 105, 115 to command it to vibrate at the desired setting.

The above description is that of current embodiments of the present invention. Various alterations and changes may be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A product dispenser system comprising:

an applicator assembly including a dispensing module for dispensing a personal product from a dispensing point;

an interchangeable surface-contacting tip assembly attachable to and removable from said applicator assembly;

a heating module adjacent to said interchangeable surface-contacting tip assembly for selectively heating a portion of said interchangeable surface-contacting tip assembly, wherein said heated portion of said interchangeable surface contacting tip assembly is remote from said dispensing point of said personal product; and a power source.

2. The product dispenser system of claim 1 wherein said heating module is located within the applicator assembly.

3. The product dispenser system of claim 1 wherein said applicator assembly includes a dispenser nozzle.

4. The product dispenser system of claim 3 wherein said portion of said interchangeable surface-contacting tip assembly is located outside said flow path of said personal product.

5. The product dispenser system of claim 1 wherein said applicator assembly includes an activation mechanism for selectively dispensing said personal product.

6. The product dispenser system of claim 1 further comprising a vibratory module.

7. The product dispenser system of claim 1 wherein said applicator assembly includes a cavity to receive said personal product in a cartridge form.

8. The product dispenser system of claim 7 wherein said personal product in cartridge form further comprises an activation mechanism for selectively dispensing said personal product.

9. A product dispenser apparatus for applying a personal product comprising:

an interchangeable surface-contacting tip assembly removable from and attachable to said product dispenser apparatus;

a dispensing module for storing and dispensing said personal product from a dispensing nozzle having a dispensing point;

a heating module adjacent to said interchangeable surface-contacting tip assembly for heating a portion of said interchangeable surface-contacting tip assembly; and wherein said heated portion of said interchangeable surface-contacting tip assembly is remote from said dispensing point of said personal product.

10. The product dispenser apparatus of claim 9 wherein said interchangeable surface-contacting tip assembly is permanently affixed to said dispensing module.

11. The product dispenser apparatus of claim 9 wherein said interchangeable surface-contacting tip assembly is detachable from said dispensing module.

12. The product dispenser apparatus of claim 9 further comprising an energy storage element.

13. The product dispenser apparatus of claim 9 wherein said interchangeable surface-contacting tip assembly is formed of material having a high thermal conductivity.

14. The product dispenser apparatus of claim 9 wherein said interchangeable surface-contacting tip assembly has a high heat capacity.

15. The product dispenser apparatus of claim 9 wherein said interchangeable surface-contacting tip assembly will remain between 37 C and 50 C for a predetermined time.

16. The product dispenser apparatus of claim 15 wherein said interchangeable surface-contacting tip assembly has a thermal mass dependent upon said predetermined time.

17. The product dispenser apparatus of claim 9 wherein said interchangeable surface-contacting tip assembly further comprises a resistive heating element.

18. The product dispenser apparatus of claim 9 wherein said interchangeable surface-contacting tip assembly is shielded from said product so as not to preheat said product prior to dispensing.

19. The product dispenser apparatus of claim 9 further comprising a vibratory module.

20. A product dispenser system for applying a personal product comprising:

an applicator assembly including:

an interchangeable surface contacting tip assembly for heating an application surface, said interchangeable surface contacting tip assembly being removable from and attachable to said applicator assembly, and a dispensing module including a dispenser nozzle, wherein a heated portion of said interchangeable surface-contacting tip assembly is remote from a dispensing point of said personal product, wherein said dispenser nozzle is adapted to dispense an amount of personal product from said dispensing point;

a base unit including an applicator receptacle, wherein said base unit transmits energy to said applicator assembly at least in response to said applicator assembly being placed in said applicator receptacle; and a heating module located in at least one of said applicator assembly and said base unit, for selectively heating said heated portion of said interchangeable surface-contacting tip assembly.

21. The product dispenser system of claim 20 wherein said base unit transmits energy to said applicator assembly using at least one of heat transfer via said heating module, inductive power transfer via a primary coil in said base unit, or electrical contacts in said base unit.

22. The product dispenser system of claim 20 wherein said base unit transmits energy to said applicator assembly in response to said applicator assembly being placed in said applicator receptacle, and in response to at least one of activation of a proximity detector, sensing presence by polling for placement of said applicator assembly in said applicator receptacle, and a user-provided input.

23. The product dispenser system of claim 20 wherein the base unit further comprises a receptacle in which said portion of said interchangeable surface-contacting tip assembly is heated.

24. The product dispenser system of claim 20 further comprising a vibratory module.

25. The product dispenser system of claim 1 wherein said portion makes contact with a product application surface.

26. The product dispenser system of claim 1 wherein said applicator assembly prevents personal product from contacting said portion of said surface-contacting tip assembly within said applicator assembly.

27. The product dispenser system of claim 1 wherein said applicator assembly dispenses unheated personal product.

* * * * *